United States Patent [19]

Cergol

[11] Patent Number: 5,072,681

[45] Date of Patent: Dec. 17, 1991

[54] PASSENGER SHIP

[75] Inventor: Maurizio Cergol, Thieste, Italy

[73] Assignee: Fincantieri Cantieri Navali Italiani S.p.A., Thieste, Italy

[21] Appl. No.: 410,214

[22] Filed: Sep. 21, 1989

[30] Foreign Application Priority Data

Sep. 26, 1988 [IT] Italy ..... 82590 A/88

[51] Int. Cl.[5] ..... B63B 1/00

[52] U.S. Cl. ..... 114/56

[58] Field of Search ..... 114/56, 65 R. 71, 72

[56] References Cited

U.S. PATENT DOCUMENTS

| | | | |
|---|---|---|---|
| 500,411 | 6/1893 | McCougall | 114/71 |
| 1,157,022 | 10/1915 | McDougall | 114/71 |
| 1,892,820 | 1/1933 | Visser | 114/71 |

*Primary Examiner*—Jesus D. Sotelo

*Attorney, Agent, or Firm*—Guido Modiano; Albert Josif

[57] ABSTRACT

A passenger ship having asymmetrical superstructures which define two distinct free spaces at the bulwarks, on the sides of the main deck. These spaces are mutually asymmetrical with respect to the diametrical plane of symmetry of the hull; the space proximate to the bow is protected on three sides, and the space proximate to the stern is protected on at least two sides. This arrangement of the superstructure allows, even with a high percentage of external cabins, to achieve extensive open-air surfaces which can be dedicated to passenger recreational activities, and all this is provided on a low deck which as such is more easily accessible and comfortable and, despite being exposed to the weather, is in any case protected by the superstructures.

16 Claims, 1 Drawing Sheet

PASSENGER SHIP

BACKGROUND OF THE INVENTION

The present invention relates to a passenger ship defined as such according to the convention known by the name SOLAS.

Known passenger ships currently have a configuration in which the cabins are usually arranged both on deck and below deck.

The external superstructures generally have a longitudinal extension which is symmetrical to the hull.

The superstructure decks have an exposed area which is generally located amidship and aft.

Due to their arrangement, said decks may furthermore be all windward or leeward, in the shade or in the sun, limiting their use for many kinds of recreational services.

Finally, it should be noted that in the uppermost decks rolling may cause unpleasant conditions for the passengers, leading said decks to be scarcely visited and therefore scarcely usable as an area for particular recreational services.

SUMMARY OF THE INVENTION

The aim of the present invention is therefore to eliminate the disadvantages described above in known kinds of passenger ship by providing in turn a passenger ship which besides having a superstructure with weights balanced transversely to said ship, allows to provide large open-air surfaces which can be dedicated to recreational activities for the passengers.

Within the scope of the above described aim, an important object is to provide a passenger ship in which said large surfaces allow recreational activities in conditions which maximally resemble the optimum ones.

The above described aim and objects, as well as others which will become apparent hereinafter, are achieved by a passenger ship characterized in that it comprises asymmetrical superstructures which define, on the sides of the deck, two distinct free spaces at the bulwarks which are mutually asymmetrical, the one proximate to the bow being protected on three sides, the one proximate to the stern being protected on at least two sides.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein.

DESCRIPTION OF THE PREFERRED EMBODIMENT

Figure 1:
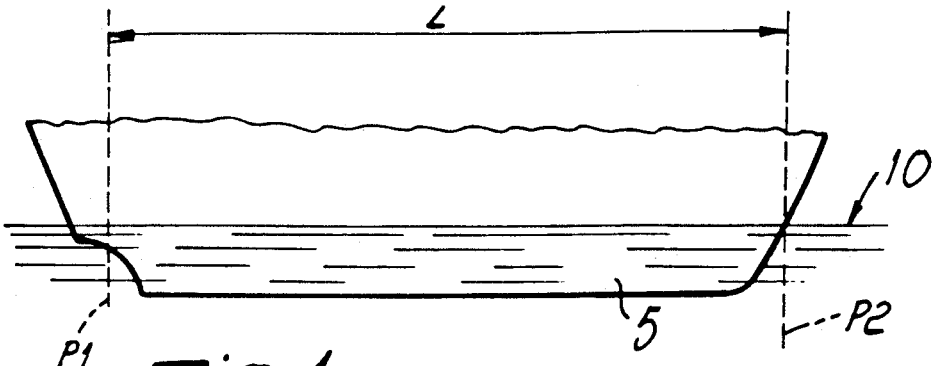
FIG. 1 is a schematic partial side view of the ship while floating with a normal full load.
Figure 2:
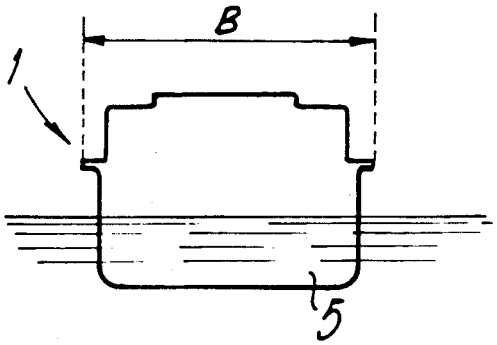
FIG. 2 is a view, taken along a transverse plane, of the ship in a schematic form.

With reference to the above described figures, the passenger ship, generally indicated by the reference numeral 1, comprises, at the deck 2, superstructures 3 which are asymmetrical and therefore have an offset configuration with respect to the diametrical plane of symmetry 4 of the hull 5.

This arrangement of the superstructures 3, which have an essentially S- or Z-shaped plan with respect to the deck 2, defines, at the port and starboard bulwarks 6 and 7, two distinct free or open spaces, indicated by the reference numeral 8 and 9.

Said free spaces are arranged offset with respect to the diametrical plane 4, and are furthermore protected by the superstructures 3 respectively on three sides and on at least two sides.

Besides providing a considerable percentage of external cabins, this distribution of the superstructures 3 allows to provide extensive open-air surfaces which can be dedicated to the passenger's recreational activities on a lower deck which, as such, is more accessible and comfortable since rolling is perceived to a lesser extent.

Said free spaces, despite being exposed to the weather, are protected by the superstructures on two or three sides, thus allowing to differentiate their use for example according to the direction from which the wind is blowing (leeward or windward exposed regions) or to the position of the sun (regions which are exposed but are in the shade or in the sun) or to the mooring at dock (regions toward the dock or toward the sea).

The particular distribution of the superstructures 3 furthermore allows to minimize or even eliminate the effect of transverse weight imbalance which for different solutions might entail a particular re-distribution of the main internal weights as compensation with respect to the conventional arrangement in known ships.

As regards the area delimiting said free spaces 8 and 9, some conditions which are deemed optimum, according to the particular configurations of the superstructures, are pointed out.

The plane which is transverse to the hull 5 and passes through the axis of the rudder is indicated by P1; P2 indicates the plane which is transverse to the hull 5 and passes through the intersection between the load water line plane 10 and the stem.

The letter L instead indicates the interspace between said two planes P1 and P2.

The letter B instead indicates the beam of the ship.

Figure 3:
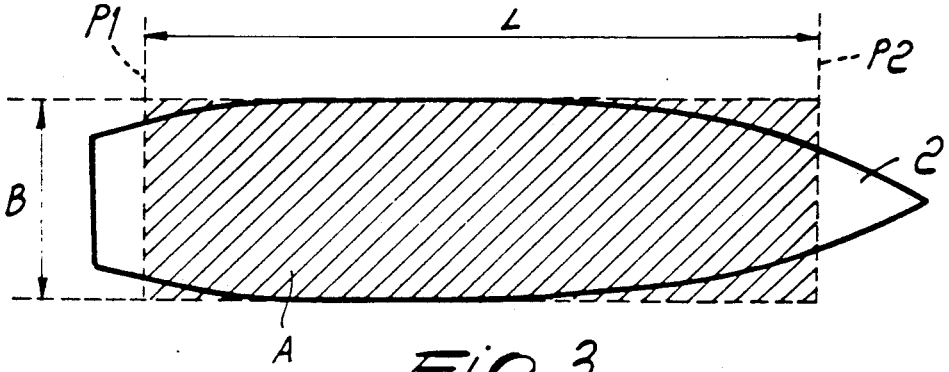
FIG. 3 is a schematic view of the main deck or external continuous deck.
Figure 4:
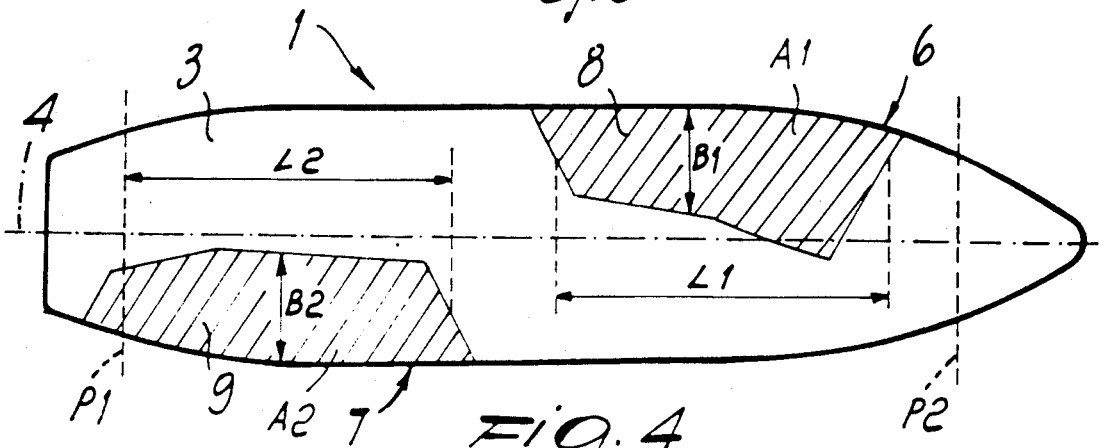
FIG. 4 is a view, similar to the preceding one, of the arrangement of the two distinct free spaces which are asymmetrical with respect to the diametrical plane of symmetry of the hull.

With reference to the main deck 2 or in any case to the horizontal plane of the outer continuous deck, the letter A indicates the theoretical total area which is projected on said plane and is obtained therefore by multiplying the beam B of the ship by the distance between the planes P1 and P2. Said area A is defined by the rectangle drawn in broken lines in FIG. 3.

The areas related to the free spaces 8 and 9 and the dimensional relationships therebetween are now defined.

A1 indicates the starboard lateral area of the free space 8 and A2 identifies the port lateral area of the free space 9.

The starboard lateral area A1 is obtained by multiplying the useful mean length L1 of the space 8 by the mean useful width B1 thereof.

It should be stressed that in calculating said area any regions which extend respectively ahead of the plane P2 or astern of the plane P1 must not be taken into account.

The port side area, indicated by A2, is instead obtained by multiplying the mean useful length L2 of the port space 9 by the mean useful width B2 thereof.

The indications provided for the preceding area also apply to the calculation of this area.

In view of the previously given definitions, the dimensions of the areas A1 and A2 are deemed to respect the following conditions, in view of the particular configuration of the superstructures 3:

$$0.80 \cdot A2 \leqq A1 \leqq 1.25 \cdot A2$$

and that $$A1 + A2 \geqq 0.20 \cdot A$$

and that $$B2 \geqq 0.3 \cdot B \text{ and } B1 \geqq 0.3 \cdot B.$$

It has thus been observed that the invention achieves the intended aim and objects, a passenger ship having been provided which by virtue of the particular distribution of its superstructures allows to provide a high percentage of external cabins arranged on deck together with large exposed surfaces which can be dedicated to passenger recreational activities; all this being provided on a low deck which, as such, is more accessible and comfortable (less roll) and despite being exposed to the weather is also protected by said superstructures on two or three sides.

The distribution of the superstructures furthermore allows to use the public open-air spaces while cruising or while the ship is stationary in a differentiated manner according to the direction from which the wind blows or to the position of the sun or to the mooring at dock.

The particular distribution of the superstructures furthermore allows to minimize or even eliminate the effect of transverse weight imbalance which in general, for other solutions, might entail a re-distribution of the main internal weights for compensation.

The shape of the free spaces 8 and 9 may naturally be the most appropriate according to the specific requirements within the scope of the previously described limitations.

The asymmetry of the superstructures with reference to their mean distribution with respect to the diametrical plane of symmetry of the hull can be achieved without regard for the geometrical shape which the body of said superstructures may assume in elevation and/or in plan, as well as for the shapes of possible bodies connecting for example the lateral superstructures or interpenetrating said superstructures or for completing the aft and bow regions.

I claim:

1. Passenger ship comprising a deck and superstructures, said deck defining a longitudinal extension, a bow, and a stern, said superstructures being arranged on said deck so as to define a first open space and a second open space, said first open space and said second open space being mutually asymmetrical with respect to said longitudinal extension, said first open space being proximate to said bow and being delimited on three sides thereof by said superstructures, said second open space being proximate to said stern and being delimited on at least two sides thereof by said superstructures.

2. Passenger ship according to claim 1, further comprising a hull, said hull having a diametrical plane of symmetry, said longitudinal extension lying in said diametrical plane of symmetry, said superstructures having an offset configuration with respect to said diametrical plane of symmetry of said hull so as to define, on each side of said ship, said first open space and said second open space.

3. Passenger ship according to claim 1, wherein said superstructures have, with respect to said deck, an essentially S-shaped plan configuration.

4. Passenger ship according to claim 1, wherein said superstructures have, with respect to said deck, an essentially Z-shaped plan configuration.

5. Passenger ship according to claim 1, wherein said first open space defines a first mean useful length and a first mean useful width, a first open space lateral area being defined which is equal to said first mean useful length multiplied by said first mean useful width, said second open space defining a second mean useful length and a second mean useful width, a second open space lateral area being defined which is equal to said second mean useful length multiplied by said second mean useful width, said first open space lateral area being equal to a value comprised between 0.80 and 1.25 of said second open space lateral area.

6. Passenger ship according to claim 5, further defining a ship beam, a rudder axis, a stem, and a full load water line, a first plane being defined which passes at said rudder axis perpendicular to said deck, a second plane being defined which passes at an intersection of said stem and said full load water line and which is also perpendicular to said deck, a deck length being defined as a distance along said deck between said first and said second planes, a theoretical total deck plane area being defined as said ship beam multiplied by said deck length, wherein said first open space lateral area plus said second open space lateral area is not less than one fifth of said theoretical total deck plane area.

7. Passenger ship according to claim 5, further defining a ship beam, wherein said first mean useful width and said second mean useful width is equal to three tenths of said ship beam.

8. Passenger ship comprising a deck and superstructures, said deck defining a longitudinal extension, a bow, and a stern, said superstructures being arranged on said deck so as to define a first open space and a second open space, said first open space and said second open space being mutually asymmetrical with respect to said longitudinal extension, said first open space being proximate to said bow and said second open space being proximate to said stern, said passenger ship further comprising a hull, said hull having a diametrical plane of symmetry, said longitudinal extension lying in said diametrical plane of symmetry, said superstructure having an offset configuration with respect to said diametrical plane of symmetry of said hull so as to define, on each side of said ship, said first open space and said second open space.

9. Passenger ship according to claim 8, wherein said first open space is delimited on three sides thereof by said superstructures and said second open space is delimited on at least two sides thereof by said superstructures.

10. Passenger ship according to claim 8, wherein said superstructures have, with respect to said deck, an essentially S-shaped plan configuration.

11. Passenger ship according to claim 8, wherein said superstructures have, with respect to said deck, an essentially Z-shaped plan configuration.

12. Passenger ship according to claim 8, wherein said first open space defines a first mean useful length and a first mean useful width, a first open space lateral area being defined which is equal to said first mean useful length multiplied by said first mean useful width, said second open space defining a second mean useful length and a second mean useful width, a second open space lateral area being defined which is equal to said second mean useful length multiplied by said second mean useful width, said first open space lateral area being equal to a value comprised between 0.80 and 1.25 of said second open space lateral area.

13. Passenger ship according to claim 12, further defining a ship beam, a rudder axis, a stem, and a full load water line, a first plane being defined which passes at said rudder axis perpendicular to said deck, a second plane being defined which passes at an intersection of said stem and said full load water line and which is also perpendicular to said deck, a deck length being defined as a distance along said deck between said first and said second planes, a theoretical total deck plane area being defined as said ship beam multiplied by said deck length, wherein said first open space lateral area plus said second open space lateral area is not less than one fifth of said theoretical total deck plane area.

14. Passenger ship according to claim 12, further defining a ship beam, wherein said first mean useful width and said second mean useful width is equal to three tenths of said ship beam.

15. Passenger ship comprising a deck and superstructures, said deck defining a longitudinal extension, a bow, and a stern, said superstructure being arranged on said deck so as to define a first open space and a second open space, said first open space and said second open space being mutually asymmetrical with respect to said longitudinal extension, said first open space being proximate to said bow and said second open space being proximate to said stern, said superstructures having, with respect to said deck, an essentially S-shaped plan configuration.

16. Passenger ship comprising a deck and superstructures, said deck defining a longitudinal extension, a bow, and a stern, said superstructures being arranged on said deck so as to define a first open space and a second open space, said first open space and said second open space being mutually asymmetrical with respect to said longitudinal extension, said first open space being proximate to said bow and said second open space being proximate to said stern, said superstructures having, with respect to said deck, an essentially Z-shaped plan configuration.

* * * * *